United States Patent [19]

Murata et al.

[11] Patent Number: 4,548,154

[45] Date of Patent: Oct. 22, 1985

[54] DOUBLE HULLED SHIP WITH LONGITUDINAL REINFORCEMENTS

[75] Inventors: Seiichiro Murata, Sakai; Toshio Yoshioka, Kawachi-nagano; Sakito Kamei, Sakai; Yoshitada Hiramatsu, Kishiwada; Shin Takeuchi, Arao; Yoshiro Yamawaki, Innoshima, all of Japan

[73] Assignee: Hitachi Zosen Corporation, Osaka, Japan

[21] Appl. No.: 628,468

[22] Filed: Jul. 6, 1984

[30] Foreign Application Priority Data

Jul. 11, 1983 [JP] Japan ..... 58-107856[U]

[51] Int. Cl.[4] ..... B63B 3/68

[52] U.S. Cl. ..... 114/355; 114/74 A

[58] Field of Search ..... 114/355, 76, 74 A, 77 R, 114/72, 73, 74 R, 74 T, 78

[56] References Cited

U.S. PATENT DOCUMENTS

| | | | |
|---|---|---|---|
| 3,085,538 | 4/1963 | Henry | 114/74 A |
| 3,797,099 | 3/1974 | Myers | 114/74 A |
| 3,804,050 | 4/1974 | Iarussi | 114/74 A |
| 3,811,593 | 5/1974 | Bridges | 114/74 A |
| 3,875,886 | 4/1975 | Glasfeld | 114/74 A |
| 3,899,989 | 8/1975 | Glasebrook | 114/74 A |

*Primary Examiner*—Trygve M. Blix
*Assistant Examiner*—C. T. Bartz
*Attorney, Agent, or Firm*—Barnes, Kisselle, Raisch, Choate, Whittemore & Hulbert

[57] ABSTRACT

A ship having at least its side portions and bottom portion comprised of a double hull construction consisting of an inner hull plating and an outer hull plating connected together solely, except for transverse bulkheads disposed in spaced apart relation in the lengthwise direction of the ship, by a plurality of connecting longitudinals fixed to the bulkheads, at least one of the connecting longitudinals having anti-buckling means extending in the lengthwise direction thereof and tripping means extending in the widthwise direction thereof. According to this arrangement, external forces exerted on the ship may be transmitted through the connecting longitudinals to the transverse bulkheads so that the inner and outer hull platings may be protected from buckling. The absence of transverses crossing the longitudinals considerably facilitates the automatization of welding operation. Furthermore, the fact that at least one of the connecting longitudinals has anti-buckling means extending in the lengthwise direction thereof and tripping means extending in the widthwise direction thereof assures that the longitudinals, or the inner and outer hull platings connected thereby will be more positively prevented from buckling.

2 Claims, 3 Drawing Figures

DOUBLE HULLED SHIP WITH LONGITUDINAL REINFORCEMENTS

The present invention relates to ships and more particularly to the hull construction of cargo ships such as tankers and the like.

When at sea, a tanker is subject to the influence of various forces, such as for example longitudinal bending moment and torsion, water pressure against its bottom and side platings, and load from the weight of the cargo oil as sustained by the inner bottom plating and side walls of its cargo holds (oil tanks). In order to cope with these forces, the hull of the tanker includes a multiplicity of longitudinals (such as side longitudinals, bottom longitudinals, and central girders) extending in the lengthwise direction thereof and a multiplicity of transverses (such as side and bottom transverses) extending in the widthwise derection thereof. In such hull construction, however, longitudinals and transverses are arranged in crossing relation, and this prevents automatization of certain works (such as, for example, welding) involved in the process of shipbuilding. With a view to facilitating the automatization of such works, therefore, the present inventors have come to the concept of a transless ship, that is, a ship of a double hull construction having longitudinals only and no transverse. However, the adoption of such double-hull construction for a ship involves various problems to be solved. For example, if said double hull construction is employed for the bottom portion only of a ship of a conventional type, the trouble is that as external forces exerted on the outer side-plating are transmitted to the bottom portion through the transverses disposed inside the outer side-plating, they would collapse the inner and outer platings of the bottom portion which has no transverse disposed therein in the widthwise direction of the ship. Similarly, if said double hull construction is employed for the side portions only of the ship, as external forces exerted on the bottom portion are transmitted to the side portions through the transverses disposed in the bottom portion, they would collapse the inner and outer platings of the side portions which have no transverse disposed therein in the vertical direction.

The object of the present invention is to provide a ship of a double hull construction having an outer hull plating and an inner hull plating connected together solely by longitudinals and which is nevetheless free from buckling possibilities with the outer and inner hull platings.

To this end, the invention presents a ship having at least its portions and bottom portion comprised of a double hull construction consisting of an inner hull plating and an outer hull plating connected together solely, except for transverse bulkheads disposed in spaced apart relation in the lengthwise direction of the ship, by a plurality of connecting longitudinals fixed to the transverse bulkheads, at least one of the connecting longitudinals having antibuckling means extending in the lengthwise direction thereof and tripping means extending in the widthwise direction thereof.

According to this arrangement, it is possible to allow any external forces exerted to the ship to be transmitted to rigidly constructed bulkheads through connecting longitudinals so as to protect the inner and outer hull platings from buckling. Moreover, at least one of the connecting longitudinals has anti-buckling means extending in the lengthwise direction thereof and tripping means extending in the widthwise direction thereof, and this assures that the connecting longitudinals, that is, the inner and outer hull platings connected thereby will be more positively prevented from buckling.

Further, the fact that the ship is of a double hull construction in which the inner and outer hull platings are integrally connected together essentially solely by connecting longitudinals affords the following advantages:

(1) The absence of transverses means a smaller number of components; and the absence of connecting longitudinal-transverse intersections greatly facilitates automatization of cetain works (such as welding, for example) involved in the process of shipbuilding and also permits easy and complete inspection of spaces defined between the inner and outer hull platings.

(2) The absence of connecting longitudinal-transverse intersections eliminates possible crack occurrences due to stress concentration at any such intersection.

(3) Spaces partitioned only by connecting longitudinals between the inner and outer hull platings can be utilized as ballast tanks. Furthermore, the fact that none of such ballast tanks are partitioned by transverses in the lengthwise direction of the ship facilitates complete discharge of water ballast.

(4) In the event that any combustible liquid or gas in any of the holds of the ship should enter the spaces between the inner and outer hull platings as a result of a damage caused to the inner hull plating, such liquid or gas can easily be expelled therefrom, since none of the spaces are partitioned by transverses in the longitudinal direction, and accordingly the ship can be protected against the danger of explosion.

(5) The absence of transverses facilitates stress analysis of the hull construction and thus permits more reasonable arrangement of components for the purpose of weight reduction.

(6) The double hull construction prevents the run off of cargo oil in the event of a collision with any other ship or of stranding.

(7) The absence of any such projection as stiffener or the like in the interior of any of the holds permits efficient and accurate painting, cleaning, and/or stripping of the hold interior. That also means reduced painting area.

These and other features and advantages of the invention will become apparent from the following description of embodiments taken in connection with the accompanying drawings in which.

Figure 1:
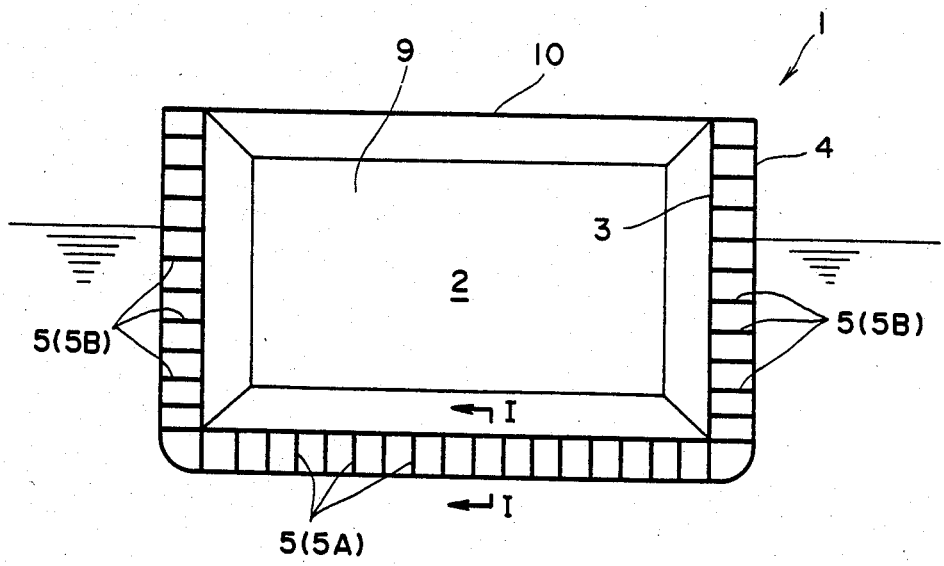
FIG. 1 is a cross-sectional view of one form of hull construction embodying the invention.

Referring to FIG. 1, numeral 1 designates a ship, or a tanker, for example. In the tanker 1, side portions and bottom portion thereof defining holds 2 are comprised of a double hull construction consisting of an inner hull plating 3 and an outer hull plating 4 connected together solely by a plurality of connecting longitudinals 5 extending in the lengthwise direction of the ship.

Figure 2:
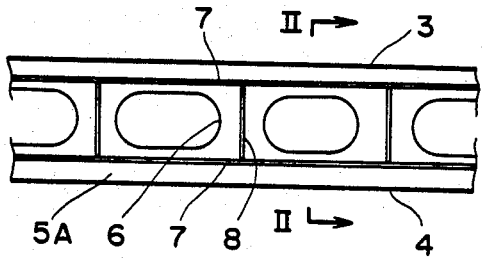
FIG. 2 is a view taken along the line I—I in FIG. 1.
Figure 3:
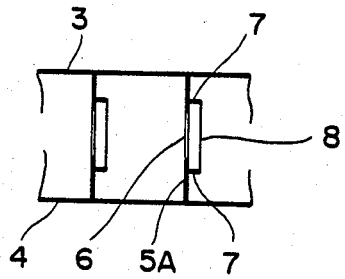
FIG. 3 is a view taken along the line II—II in FIG. 2.

As FIGS. 2 and 3 show, each connecting longitudinal 5A in the bottom portion of the ship has lightening holes 6 provided in suitably spaced apart relation in the lengthwise direction thereof. The longitudinal 5A has anti-buckling means 7 disposed above and below the lightening holes 6 and extending in the lengthwise direction of the longitudinal 5A. It also has a plurality of tripping means 8, each disposed between each two adjacent lightening holes 6 and extending in the widthwise direction thereof. The anti-buckling means 7 and tripping means 8, both comprise straight flat bars projecting perpendicularly from the longitudinal 5A.

Unlike a ship of a conventional construction, the ship in accordance with the invention has no transverse disposed therein, which fact would mean reduced strength of the inner and outer hull platings 3, 4 against buckling, if no compensating means are provided. By way of compensation, therefore, connecting longitudinals 5 are arranged in a larger number, with the individual longitudinals 5 narrowly spaced from one another; and accordingly minor other longitudinals are dispensed with. Since no transverse is provided, forces exerted on the connecting longitudinals 5A in the bottom portion of the ship do not extend to the inner and outer hull platings 3, 4 of the side portions. For similar reason, forces exerted on the connecting longitudinals 5B in the side portions do not extend to the inner and outer hull platings 3, 4 of the bottom portion or to upper deck portion. Instead, all these forces are transmitted to transverse bulkheads 9 which separate the holds 2 from one another. As such, the transverse bulkheads 9 are reinforced accordingly. For example, each bulk head 9 is constructed of a corrugated plate so that it may withstand omni-directional external forces. Further, a box-shaped structure may be provided around the corrugated plate as required. It is noted that the upper deck 10 is of a construction essentially similar to that of a conventional one, and therefore, reinforcing members not shown are suitably disposed.

What is claimed is:

1. A ship having at least its side portions and bottom portion comprised of a double hull construction consisting of an inner hull plating and an outer hull plating connected together by transverse bulkheads and a plurality of connecting longitudinals fixed to the transverse bulkheads and reinforced by anti-buckling means, wherein (a) there are no transverses, other than said transverse bulkheads, intersecting said connecting longitudinals, and (b) said anti-buckling means comprises a pair of parallel straight flat bars attached perpendicularly to and extending lengthwise of each connecting longitudinal in the bottom portion of the ship and a plurality of parallel straight flat bars attached perpendicularly to and extending widthwise of each bottom portion connection longitudinal between the lengthwise extending bars, both ends of each widthwise extending bar being in contact with the lengthwise extending bars.

2. A ship as defined in claim 1 wherein the lengthwise extending bars are arranged respectively above and below lightening holes formed in each bottom portion connecting longitudinal, and each widthwise extending bar is disposed between two adjacent lightening holes.

* * * * *